United States Patent [19]

Vits

[11] 3,993,301

[45] Nov. 23, 1976

[54] DEVICE FOR RAISING THE TOP SHEET OF A PILE BY BLAST AIR

[75] Inventor: Hilmar Vits, Leichlingen, Germany

[73] Assignee: Vits-Maschinenbau GmbH, Langenfeld, Germany

[22] Filed: June 12, 1975

[21] Appl. No.: 586,315

[30] Foreign Application Priority Data

June 19, 1974 Germany ..... 2429421

[52] U.S. Cl. ..... 271/98; 294/64 R; 294/64 B

[51] Int. Cl.[2] ..... B65H 3/14; B66C 1/02

[58] Field of Search ..... 294/64 R, 64 A, 64 B; 271/97, 98, 195; 302/21, 25, 29, 31

[56] References Cited

UNITED STATES PATENTS

| | | | |
|---|---|---|---|
| 3,070,367 | 12/1962 | Schwebel | 271/98 X |
| 3,223,443 | 12/1965 | Misson | 294/64 R X |
| 3,438,668 | 4/1969 | Olsson et al. | 294/64 R |
| 3,517,958 | 6/1970 | Boucher et al. | 294/64 R |
| 3,523,706 | 8/1970 | Logue | 294/64 R |
| 3,831,930 | 8/1974 | Shimizu | 271/98 X |

FOREIGN PATENTS OR APPLICATIONS

| | | | |
|---|---|---|---|
| 1,054,966 | 1/1967 | United Kingdom | 294/64 B |
| 944,175 | 12/1963 | United Kingdom | 294/64 B |

*Primary Examiner*—Johnny D. Cherry
*Attorney, Agent, or Firm*—Burgess, Dinklage & Sprung

[57] ABSTRACT

An apparatus for lifting a top sheet of material from a stack of material which comprises a generally flat foot member having an arcuately shaped channel cutout on its surface, said channel being in gaseous communication with an internal conduit, said internal conduit, in turn, being in gaseous communication with a source of gas under positive elevated pressure.

6 Claims, 5 Drawing Figures

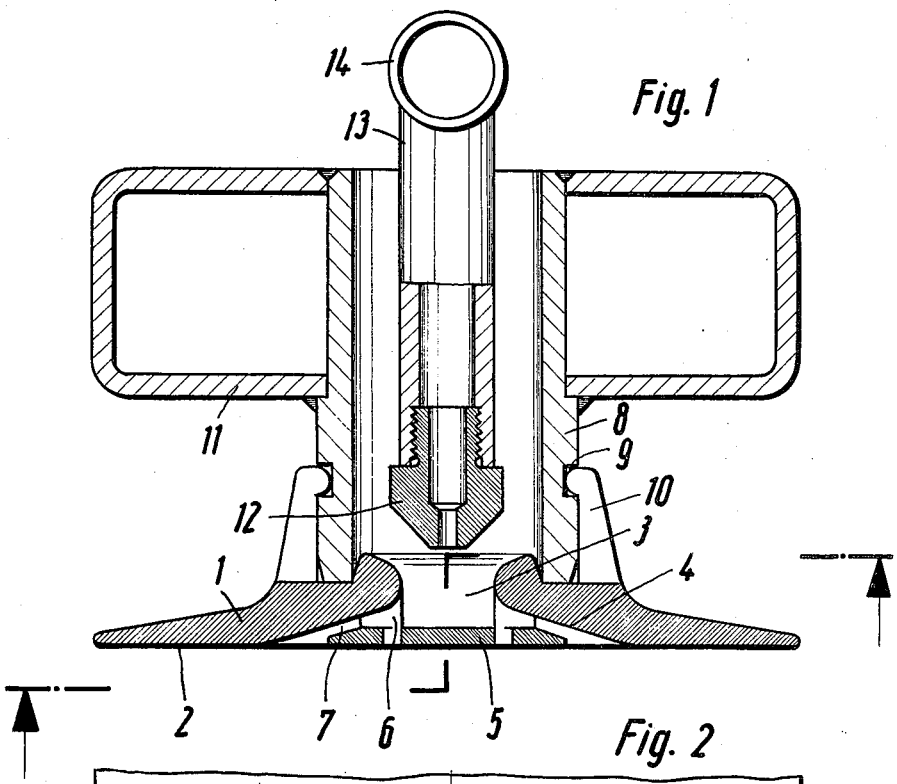
Fig. 1
Fig. 2
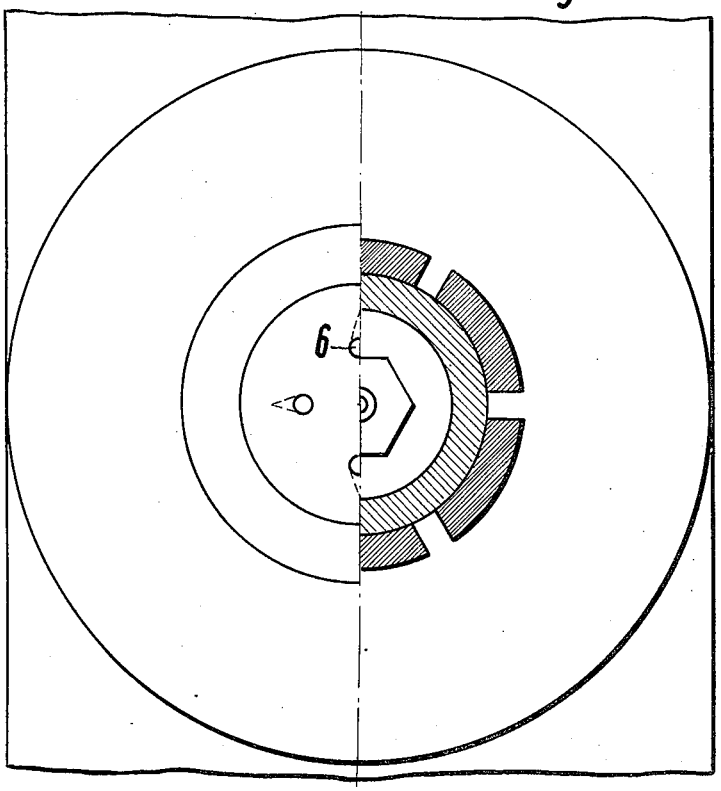

DEVICE FOR RAISING THE TOP SHEET OF A PILE BY BLAST AIR

BACKGROUND OF THE INVENTION

1. Field of the Invention

This invention relates to an apparatus for lifting the top sheet of material from a stack of materials. More particularly, this invention relates to an apparatus for lifting a top sheet of material from a stack of material by use of a gas under a positive elevated pressure which gas is discharged from a central gaseous conduit in an outwardly radial direction through an arcuately or ring-shaped conduit.

2. Discussion of the Prior Art

Numerous devices have heretofore been proposed for raising the top sheet of a stack of sheets arranged in the form of a pile. Generally speaking, those devices which have heretofore been proposed have been devices which operate by the use of a negative pressure (partial vacuum) and thus aspirate or suck the top sheet upwardly. In order to raise the sheet, these partial vacuum apparatuses are positioned quite close to the front of the back edge of the sheet and grip it by means of a vacuum. The probability that, apart from the top sheet, sheets positioned directly therebelow are also raised is relatively high, especially when it is desired to raise the top sheet of a pile of sheets which is made of a porous material. In such instances the vacuum exerted against the top sheet is usually of such a magnitude that it tends to effect those sheets disposed beneath the top sheets. For this reason a series of measures has been taken, e.g., the provision of small spring brushes past which the edge of the sheet has to be guided so that a lower sheet is prevented from adhering to the top sheet.

A further proposed measure for raising a top sheet apart from sheets therebeneath has involved the blasting of the front edge of the sheet with a blast of air so that small air pockets are formed between the upper sheets. Moreover, the suckers work with strong suction air but with small diameter as it has been shown that the tendency to entrain a sheet is less when the cross section of the sucker means is small in relation to the strength of the paper.

Finally, the tilting of the top sheet by means of a sucker member has also been known. This has been provided so that the stiffness of the underlying sheet aids the raising of the top sheet. However, all of the measures heretofore proposed have not been sufficient to guarantee that only the top sheet is raised.

Apart from the suction members heretofore proposed, which without exception work by the use of negative air pressure, the raising of the top sheet by use of blast nozzles working in conjunction with suction nozzles is known. These blast nozzles have a flat front side which in turn has a blast air outlet aperture disposed in the middle thereof. In this device, the blast stream is directed against the sheet and the sheet is sucked away by laterally arranged suction nozzles operated at negative pressure. However, it is doubtful that such a device is able to raise the top sheet, apart from other sheets, without entraining sheets underlying the same. In such connection reference is made to German Auslegeschrift No. 1,060,874.

It therefore became desirable to provide a device which would guarantee that only the top sheet of a pile of sheets was raised. More particularly, it became desirable to provide an apparatus which not only would raise only a top sheet of a pile of sheets but would hold that top sheet in a raised position independent of the sheets disposed therebeneath. Finally, it became desirable to provide an apparatus for raising the top sheet of a pile of sheets which guaranteed a safe separation even when the top sheet was porous to air.

SUMMARY OF THE INVENTION

The objects of the invention are answered by an apparatus for lifting a top sheet of material from a stack of material which apparatus comprises a generally flat foot member having an arcuately shaped channel cutout on its surface, said channel being in gaseous communication with an internal conduit, said internal conduit, in turn, being in gaseous communication with a source of gas under positive elevated pressure.

In the device of the present invention there is a generally planar foot member which has an inner surface. This inner surface is centrally disposed and is in facing relationship with an internal gas conduit. The internal gas conduit, in turn, is in gaseous communication with a source of gas under positive elevated pressure. The foot member can be considered to comprise a centrally disposed presser member centrally disposed of an exteriorly disposed presser member. The exteriorly disposed presser member has a surface coplanar with the exterior surface of the centrally disposed presser member. However, a portion of the surface of the exteriorly disposed presser member is sunken and is disposed behind and in partial facing relationship to the interior or rear side of the centrally disposed presser member which is generally in the form of a plate. By such a construction there is defined an arcuately shaped channel cutout. This arcuately shaped channel cutout radiates outwardly from the internal conduit to the atmosphere. Thus gas passing from the internal conduit passes outwardly through the arcuately shaped channel cutout in a radial direction. When it leaves the arcuately shaped cutout it strikes the top surface of a top sheet of material causing the same to be raised so that it abuts the flat surface of the foot member.

The apparatus of the invention preferably comprises an interiorly disposed nozzle which functions as the internal conduit. This nozzle serves to transmit blast gas, e.g., air, against the internal surface of the centrally disposed presser member. However, instead of employing a centrally aligned blast nozzle, the device can operate by the use of a larger conduit which is free of a nozzle fitting. In such instance the larger dimensioned internal conduit serves to overlie the opening to the radially projecting channel which protrudes from between the centrally disposed presser member and the exteriorly disposed presser members. In such instance the gas under pressure passes through the internal conduit and thus directly enters the radially directing channel.

In a particularly desired embodiment of the invention there is provided a means for holding a raised sheet to the apparatus which means comprises a vacuum inlet in gaseous communication via a plenum to a source of negative pressure (partial vacuum). The sheet holding means generally has a contact surface integrally connected with the foot member of the sheet raising apparatus. Thus by the use of blast gas under positive elevated pressure a sheet is raised into contact with the foot member of the sheet raising apparatus and it is held in that position owing to the juxtaposition of a sheet holding means which operates by the use of a partial vacuum which serves to hold the raised sheet against the contact surface. In one preferred embodiment the contact surface of the sheet holding means is coplanar with the surface of the foot member while in still another desired embodiment the contact surface of the sheet holding means meets the surface of the foot member at an angle. The latter embodiment is particularly useful in raising an edge of the raised sheet of paper.

Thus the objects of the invention are solved by a device in which there is provided a blast air outlet aperture which is constructed in the form of a ring or an arc shaped slot which permits for the radial escape of blast air. The ring slot is formed by a baffle plate arranged in front of the center of the blast air outlet aperture and the inner edge of the front side.

With the device of the invention an air blast leaves the apparatus in the form of a source flow which raises the top sheet from a relatively large distance as the latter is simultaneously ventilated. The additional suction nozzles operating under negative pressure help the raising process but are not required. The radially extending slot need not be in an annular shape, i.e., in the shape of a ring for it is sufficient that the arcuately shaped radially extending slot be in the form of an arc of, say, 270°. It is also feasible within the scope of the invention to employ a plurality of arcuately running radially extending slots such as two arcs each of 120°. The latter has been found to provide good results.

The region of the front side of the sheet raising apparatus in front of which the baffle plate is arranged is, as indicated above, preferably sunk, the baffle plate being arranged in the sump region so that its outer side forms a substantially flat contact surface for the raised sheet with the remaining region of the front side. Generally, the outlet aperture is fed by blast air through a tube connected to a central blast air source. However, it has been shown that the remote raising effect of the device can be improved in that the blast air outlet aperture can be opened to the atmosphere at its back.

As the sheet can be maintained raised by the blast air streaming between the front side and the raised side but not fixed in its plane by the device because of this film of air, at least one suction nozzle can be provided for maintaining the raised sheet in the sheet plane without having it moved. In such an instance the contact surface of the suction nozzle is arranged to lie in the plane of the front side. In addition, the plane of the front side and the suction nozzles can be tilted so as to bend the front edge of the raised sheet.

BRIEF DESCRIPTION OF DRAWINGS

In order to more fully understand the invention reference is made to the accompanying drawings in which:

FIG. 1 is an axial section of the device fixed at a rail;

FIG. 2 is a device according to FIG. 1 taken partially in section according to the lines of FIG. 1;

DESCRIPTION OF SPECIFIC EMBODIMENTS

Figure 4:
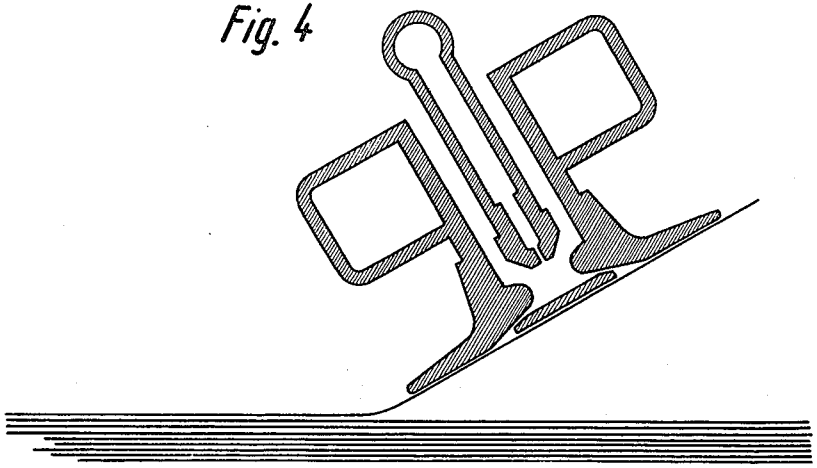
FIG. 4 is a device according to FIG. 1 schematically represented with the raised top sheet of a pile.

Referring to the drawings and especially FIGS. 1 and 2, there is shown a device having a plate 1. This plate has a circular front side 2 which is generally flat. Plate 1 has a central aperture 3 which faces the back of baffle plate 5. The transfer region between the aperture 3 and the flat front side 2 is formed by a sunken region 4 in which there lies the baffle plate 5. Baffle plate 5 lies in overlapping relationship to the raised portion of plate 1 which raised portion is sunken and protrudes inwardly from the exterior surface thereof. The baffle plate 5 is fixed to the plate 1 by means of pins 6 arranged according to FIGS. 1 and 2 to be dispersed accordingly. The baffle plate 5 and the sunken region 4 of the plate 1 form an annular gap or channel 7 through which passes a blast of air. Annular gap 7 runs radially and serves as a blast air outlet aperture. The plate 1 is fixed to pipe 8 by means of claws 10 of plate 1 engaging an outer groove in pipe support 8. The pipe support 8 penetrates a pipe 11 and is fixed therein. In the pipe support 8 and in front of the central aperture 3 there is positioned a blast air nozzle 12 held centrally in the pipe support 8 by a pipe piece 13 connected to a conduit 14.

The blast air supplied to the nozzle 12 from the conduit 14 via the pipe piece 13 enters an area formed by the middle recess 3 of the plate 1 and the baffle plate 5 at high speed, this area being opened at the back of the nozzle 12 and being arranged and spaced from the inner plate edge and the pipe support 8. It has been shown that such an arrangement is advantageous for the efficiency of the device. The blast air blown out at great speed strikes the baffle plate 5 by which it is radially deflected outwardly. Then it flows radially to all sides of the front side of the device via the annular gap 7 narrowing in the flow direction. Here the blast air exerts a sucking force.

In FIG. 4 there is shown how the top sheet is disposed adjacent to the blast nozzle when the blast nozzle is inclined. In the embodiment of FIG. 4 it is preferred to dispose the blast nozzle at an angle to the direction of the vacuum orifice. As the top sheet is sucked by means of blast air, the formation of underpressure between the sucked top sheet and the sheet directly thereunder is prevented, particularly when the sheets are porous.

Alternatively, the pipe 13 with the nozzle 12 can be omitted. In such an instance the feed of the blast gas under pressure is through internal conduit 8 which overlies the entrance to the annular gap 7.

Figure 5:
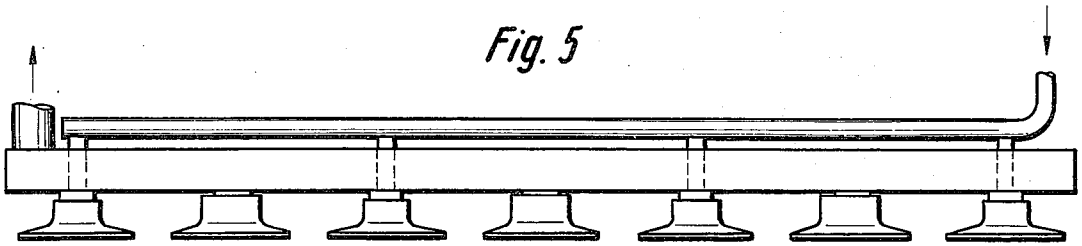
FIG. 5 shows the arrangement of several devices in a row next to one another having blast air outlet apertures and suction nozzles, the various apparatuses being seen from the front.

Several devices of the type described are preferably arranged in series with suction nozzles as shown in FIG. 5. In such an embodiment the devices operating with blast air assume the function of raising the top sheet while those devices equipped with suction nozzles insure that the top sheet lies adjacent thereto without slipping so that it can be entrained by the device.

Figure 3:
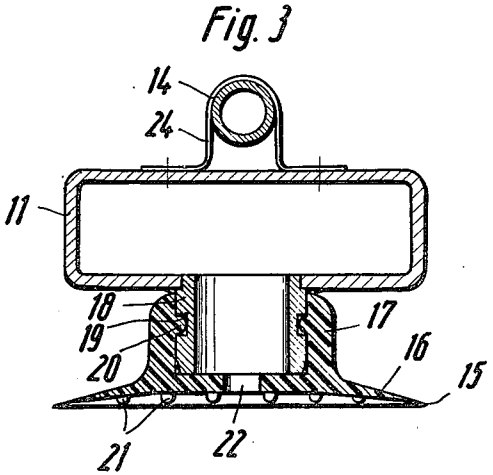
FIG. 3 is an axial section of a vacuum suction means fixed at the rail.

The suction nozzle represented in FIG. 3 comprises a plate 16 having a sealing edge 15 which at the back has a pipe-shaped projection 17. This pipe-shaped projection 17 is disposed on a pipe support 18 and is fixed axially without moving thereon by noses 20 which engage in an outer groove 19. On its outer side, the plate has members 21 which support the sheet to be sucked. In the middle, an aperture 22 is provided in the plate which communicates with pipe support 18 which, in turn, is in gaseous communication with the pipe or plenum 11. This latter conduit carries the conduit 14 containing the gas under pressure enroute to the nozzle 12 or the internal conduit 8. Conduit 14 is held to the exterior of conduit 11 by means of straps 24.

The combination of blast air nozzles and suction nozzles is effective in the raising of a single top sheet from a stack of sheets and the maintenance of the so raised sheet. By the device of the present invention blast air nozzles and suction nozzles can be effectively and compactly juxtaposed. Complicated mechanical controls for the movement of the device are not required as the devices working with blast air still have a sufficient effect when spaced quite far apart so that top sheets are safely and assuredly raised. They are held safely for displacement by the suction nozzles which do not have a comparably remote effect. Because of the remote effect of the device working exclusively on a top sheet by its blast air, any unevenness in the top sheet presents no problems in the raising operation.

What is claimed is:

1. An apparatus for lifting a top sheet of material from a stack of material which comprises a generally flat foot member having an arcuately shaped channel cutout on its lower surface disposed about a centrally positioned baffle plate, said channel being in gaseous communication with an internal conduit, said internal conduit, in turn, being in gaseous communication with a source of gas under positive elevated pressure, said internal conduit being in facing relationship to said baffle plate and being positioned within an exteriorly running conduit running generally parallel thereto which at its end opposed from said baffle is open to the atmosphere.

2. An apparatus according to claim 1 wherein said foot member has an inner surface in generally facing relationship with said internal conduit.

3. An apparatus according to claim 2 wherein said foot member comprises said baffle plate and an exteriorly disposed presser member, said exteriorly disposed presser member arranged with respect to said baffle plate to define said arcuately shaped channel cutout, said exteriorly disposed presser member having inwardly directed sunken surfaces disposed behind and in overlapping relationship to the inner surface of said baffle plate.

4. An apparatus according to claim 3 wherein said internal conduit overlies said arcuately shaped channel cutout.

5. An apparatus according to claim 1 wherein adjacent said foot member there is a sheet holding means comprising a contact surface and a vacuum inlet in gaseous communication with a plenum to a source of negative pressure whereby a negative pressure is established to hold a raised sheet against said contact surface.

6. An apparatus according to claim 5 wherein a portion of said contact surface is concave.

* * * * *